US007997764B1

(12) United States Patent
Nielson

(10) Patent No.: US 7,997,764 B1
(45) Date of Patent: Aug. 16, 2011

(54) FLASHING LIGHT MODULE FOR A TRAFFIC SAFETY CONE

(76) Inventor: Lewis A. Nielson, Murray, UT (US)

( * ) Notice: Subject to any disclaimer, the term of this patent is extended or adjusted under 35 U.S.C. 154(b) by 0 days.

(21) Appl. No.: 12/714,510

(22) Filed: Feb. 28, 2010

(51) Int. Cl.
*F21V 21/00* (2006.01)
*G08G 1/09* (2006.01)

(52) U.S. Cl. ..... 362/249.02; 362/253; 362/183; 362/191; 340/907

(58) Field of Classification Search ..... 362/183, 362/253, 234, 190, 336, 228, 184, 186, 191, 362/267, 249.02; 340/908.1, 907, 908
See application file for complete search history.

(56) References Cited

U.S. PATENT DOCUMENTS

| | | | | | |
|---|---|---|---|---|---|
| 2,949,531 | A * | 8/1960 | Lemelson | 362/253 |
| 3,132,624 | A * | 5/1964 | Shoemaker, Jr. | 116/63 R |
| D277,739 | S | 2/1985 | Grammas et al. | |
| D315,874 | S | 4/1991 | DeCaro | |
| 5,081,568 | A * | 1/1992 | Dong et al. | 362/184 |
| 5,152,601 | A * | 10/1992 | Ferng | 362/183 |
| 5,269,251 | A | 12/1993 | Freeman | |
| 5,294,924 | A * | 3/1994 | Dydzyk | 340/908.1 |
| 5,577,824 | A | 11/1996 | Wright | |
| 5,754,124 | A * | 5/1998 | Daggett et al. | 340/908.1 |
| 5,755,174 | A | 5/1998 | Freeman | |
| D411,810 | S | 7/1999 | Stockman | |
| 6,086,220 | A * | 7/2000 | Lash et al. | 362/244 |
| 6,499,858 | B2 | 12/2002 | Hart | |
| 6,556,147 | B1 * | 4/2003 | Fisher et al. | 340/908 |
| 6,753,762 | B1 * | 6/2004 | Jorba Gonzalez | 340/333 |
| 7,195,370 | B2 * | 3/2007 | Riblett et al. | 362/120 |
| 7,267,453 | B2 * | 9/2007 | Chang et al. | 362/120 |
| 7,623,026 | B2 * | 11/2009 | Martin et al. | 340/473 |
| 2006/0132323 | A1 * | 6/2006 | Grady, Jr. | 340/815.45 |

* cited by examiner

*Primary Examiner* — Ali Alavi
(74) *Attorney, Agent, or Firm* — Angus C. Fox, III; Marian J. Furst

(57) ABSTRACT

Flashing light module for a traffic safety cone has multiple stacked arrays of LED lights providing 360-degree visibility around the cone. The LED arrays are mounted onto a battery container, and a transparent or translucent housing covers the arrays and mounts onto the battery container to provide a water-tight seal for the enclosed electronics. The battery container fits into the upper opening in a truncated traffic safety cone. The LED light arrays have a variable flash rate. Optionally, an ambient light sensor is used to control the intensity of the light produced by the LED lights.

15 Claims, 10 Drawing Sheets

FLASHING LIGHT MODULE FOR A TRAFFIC SAFETY CONE

FIELD OF THE INVENTION

The present invention relates generally to traffic control systems and more particularly to a flashing light module that can be installed on the top of a modified traffic safety cone and to a modified traffic safety cone incorporating a flashing light module.

BACKGROUND OF THE INVENTION

Marker cones have long been used as a substitute for paint-marked lanes in the temporary direction of traffic and for delineating areas with pedestrian traffic, such as crosswalks. Traffic cones are typically low-cost, brightly-colored, hollow, light-weight, stackable markers made of an elastomeric material so as to minimize damage to vehicles and the markers, themselves, when vehicles inadvertently collide with them. Their conical shape, with a base larger than the top of the cone, provides stability and helps prevent the cone from being knocked over by wind, traffic, or other causes.

To enhance visibility of marker cones, especially at night, numerous attempts have been made to equip the cones with various illumination devices. For example, various types of lights have been mounted onto the tops of the safety cones, with power sources either on top of the cones adjacent the light or with the power source positioned below the light inside the cone, with an electrical line connecting the light to the power source. One example of such an illuminated cone is described in copending U.S. patent application Ser. No. 12/423,871, filed by Lewis A. Nielson in April, 2009, which is incorporated herein by reference in its entirety. Illuminated bases have also been proposed for use with traffic safety cones.

Some of the disadvantages of existing lighted cones include:

- limited angles of visibility;
- a pre-set light intensity that isn't variable depending on ambient light conditions, such as bright sunshine, overcast daylight, and darkness;
- constant illumination or invariable flash rates;
- a water-proof seal to protect electronics from moisture due to rain, snow, sleet, etc. as well as water splashed or sprayed onto the cone;
- a relatively high center of gravity for units mounted above or adjacent the top of the cone, making the cone and light assembly prone to tipping over; and
- high energy requirements for conventional light bulbs.

SUMMARY OF THE INVENTION

To achieve the foregoing and other objects and in accordance with the purpose of the present invention broadly described herein, one embodiment of this invention comprises a light module for a traffic safety cone. The module includes a base having a radially outward-extending flange, with the flange sized to support the module on a traffic safety cone with the base substantially within the cone. The module also has a light-transmissive housing and means for removably joining the housing and the base with a substantially water-tight seal between the housing and the base. A radial array of light sources is within the housing, with the light sources operative to provide light visible in a 360-degree arc around the light module. In addition, the module includes means for supporting the radial array of light sources on the base and electrical circuitry for operating and controlling the light sources.

The light module base may comprise an electrically insulating battery container having a space therein sized to accommodate a battery. A container lid covers the space in the battery container and has an opening therethrough sized to accommodate electrical wires. A battery within the space in the battery container is in electrical communication with the electrical circuitry.

The means for removably joining the housing and the base may comprise a tongue-and-groove mating system and a resilient seal. The means for supporting the radial array may comprise a substantially planar board onto which the light sources are mounted, with a plurality of posts holding the board above the container lid. The board may comprise a printed electrical circuit board. There may be additional radial arrays of light sources within the housing, stacked parallel to and spaced apart from each other. The additional arrays may be mounted onto printed circuit boards. The electrical circuitry is preferably contained within the enclosed space formed between the battery container and the housing, with the circuitry comprising at least one component selected from the group of on/off switches, light flash rate controllers, ambient light sensors, light intensity controllers, connectors for recharging the battery, solar cells for recharging the battery, and combinations thereof. The light module may further comprise means for coordinating light flashes of the array of light sources with light flashes of arrays of light sources in nearby modules. Also, the light module may further comprise a connector for receiving power from an external power source. The battery may be rechargeable, with the module further comprising a connector for recharging the battery from an external power source.

Another embodiment of the present invention comprises a traffic safety cone with a light module. The module comprises a base having a radially outward-extending flange, the flange sized to support the module on a traffic safety cone with the base substantially within the cone and a light-transmissive housing, with means for removably joining the housing and the base to form an enclosed space with a substantially water-tight seal between the housing and the base. A radial array of light sources is within the housing, and the light sources are operative to provide light visible in a 360-degree arc around the light module. The module also comprises means for supporting the radial array of light sources on the base and electrical circuitry for operating and controlling the light sources. The cone has a truncated top portion that provides an opening sized to receive the base and support the base via the flange.

The module base may comprise an electrically insulating battery container having a space therein sized to accommodate a battery, along with a container lid covering the space in the battery container. The lid has an opening therethrough sized to accommodate electrical wires. A battery is within the space in the battery container, in electrical communication with the electrical circuitry.

The means for removably joining the housing and the container may comprise a tongue-and-groove mating system and a resilient seal. The means for supporting the radial array may comprise a substantially planar board onto which the light sources are mounted, with a plurality of posts holding the board above the container lid. The board may comprise a printed electrical circuit board. There may be additional radial arrays of light sources within the housing, with the arrays stacked parallel to and spaced apart from each other. The additional radial arrays may be mounted onto printed circuit boards. The traffic safety cone of claim 12, wherein the electrical circuitry is contained within the enclosed space formed between the base and the housing, the circuitry comprising at least one component selected from the group of on/off switches, light flash rate controllers, ambient light sensors, light intensity controllers, connectors for recharging the battery, solar cells for recharging the battery, and combinations thereof. The light module may further comprise a connector for receiving power from an external power source. The light module may include a rechargeable battery and a connector for recharging the battery from an external power source.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENTS

One embodiment of the present invention comprises a light unit for a traffic safety cone. The light is emitted in a full circle about the cone and is visible from any direction. In the following discussion, terms relating to orientation, such as top, bottom, upper, and lower, refer to the orientation of the various components of the present invention when in use or when placed atop a horizontal surface.

Figure 1:
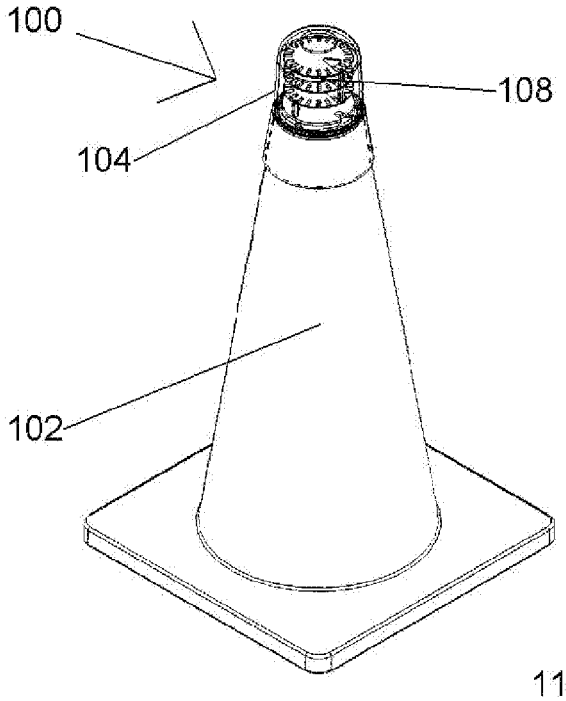
FIG. 1 is a front perspective view of one embodiment of a flashing light module mounted on a traffic safety cone in accordance with the present invention.
Figure 2:
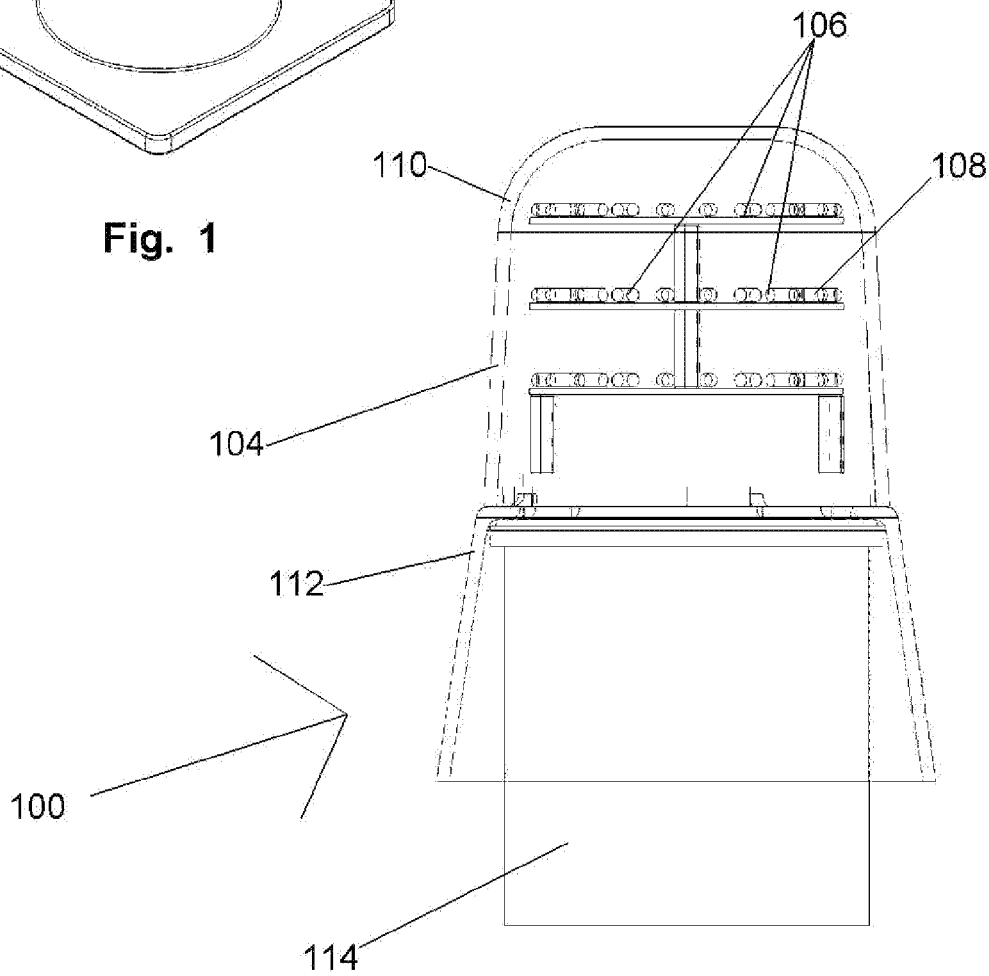
FIG. 2 is a front view of the flashing light module of FIG. 1.

One embodiment of a light module in accordance with the present invention is shown as 100 in FIGS. 1-2. Light module 100 is mounted onto a traffic safety cone 102 with a truncated top. A transparent or translucent, waterproof, housing 104 covers one or more arrays of LED lights 106 and associated electrical circuitry and provides protection from water, snow, ice, etc. for the internal parts of the light unit 108. An upper housing 110 and a lower housing 112 may be integrally formed or bonded to each other to form housing 104. Lower housing 112 is mounted onto battery container 114.

Figure 3:
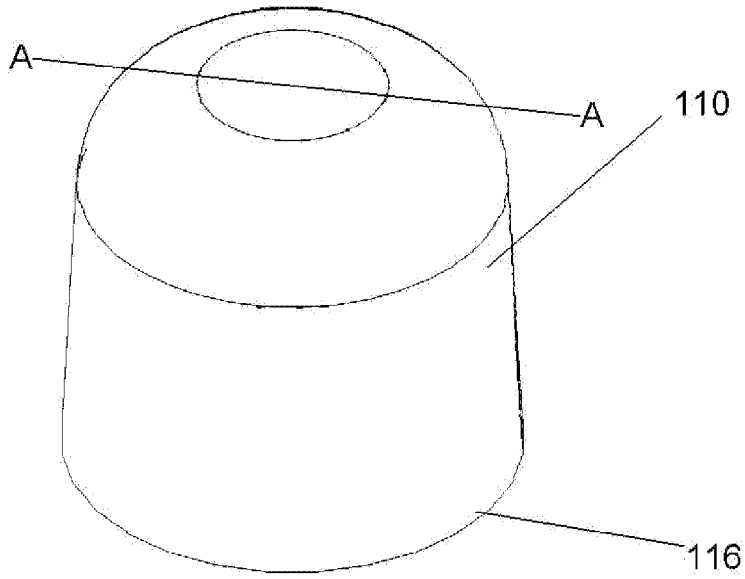
FIG. 3 is a perspective view of the upper housing of the flashing light module of FIG. 1.
Figure 4:
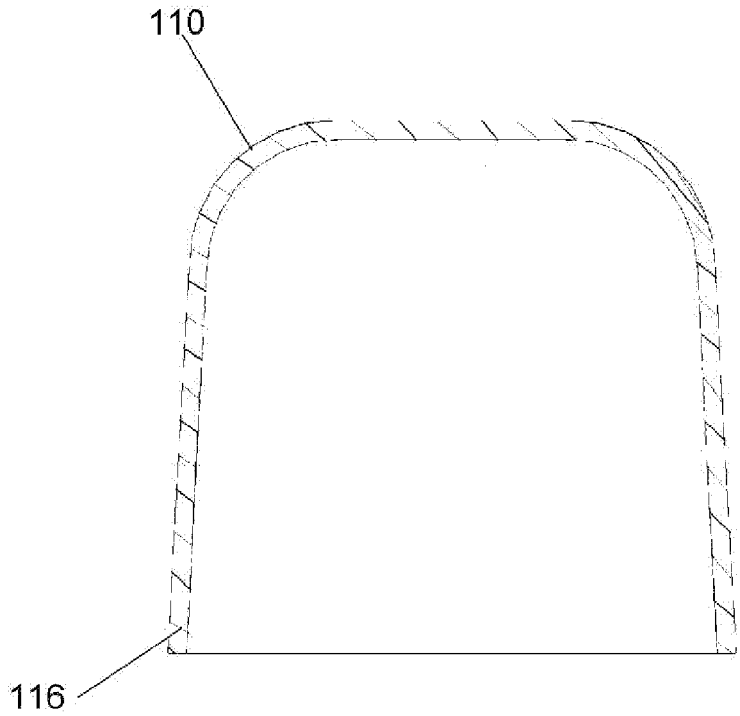
FIG. 4 is a cross sectional view of the upper housing of the flashing light module of FIG. 1 along plane A-A.

Upper housing 110 is shown in detail in FIGS. 3-4. It is sized to fit over the arrays of LED lights 106 and electronics, with a lower edge 116, a shape generally like an inverted cup or dome, and a substantially circular cross section in a horizontal plane when positioned on a horizontal surface or onto a traffic cone.

Figure 5:
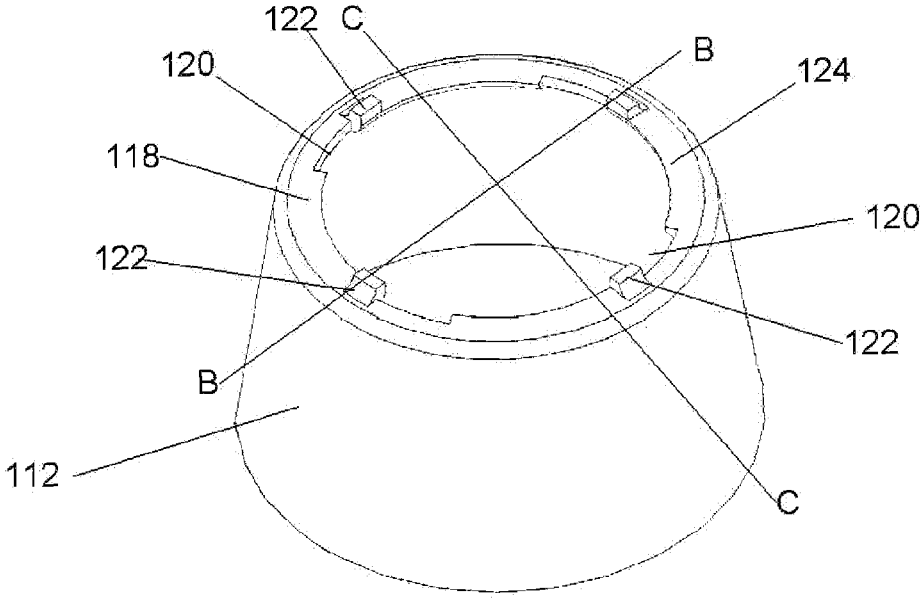
FIG. 5 is a perspective view of the lower housing of the flashing light module of FIG. 1.
Figure 6:
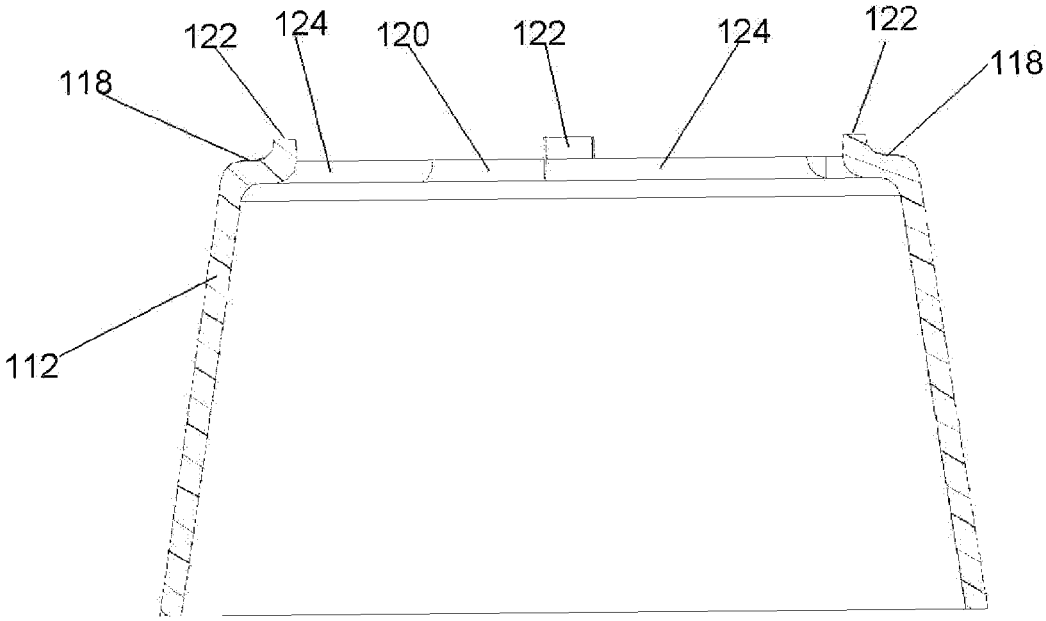
FIG. 6 is a cross sectional view of the lower housing of the flashing light module of FIG. 1 along plane B-B.
Figure 7:
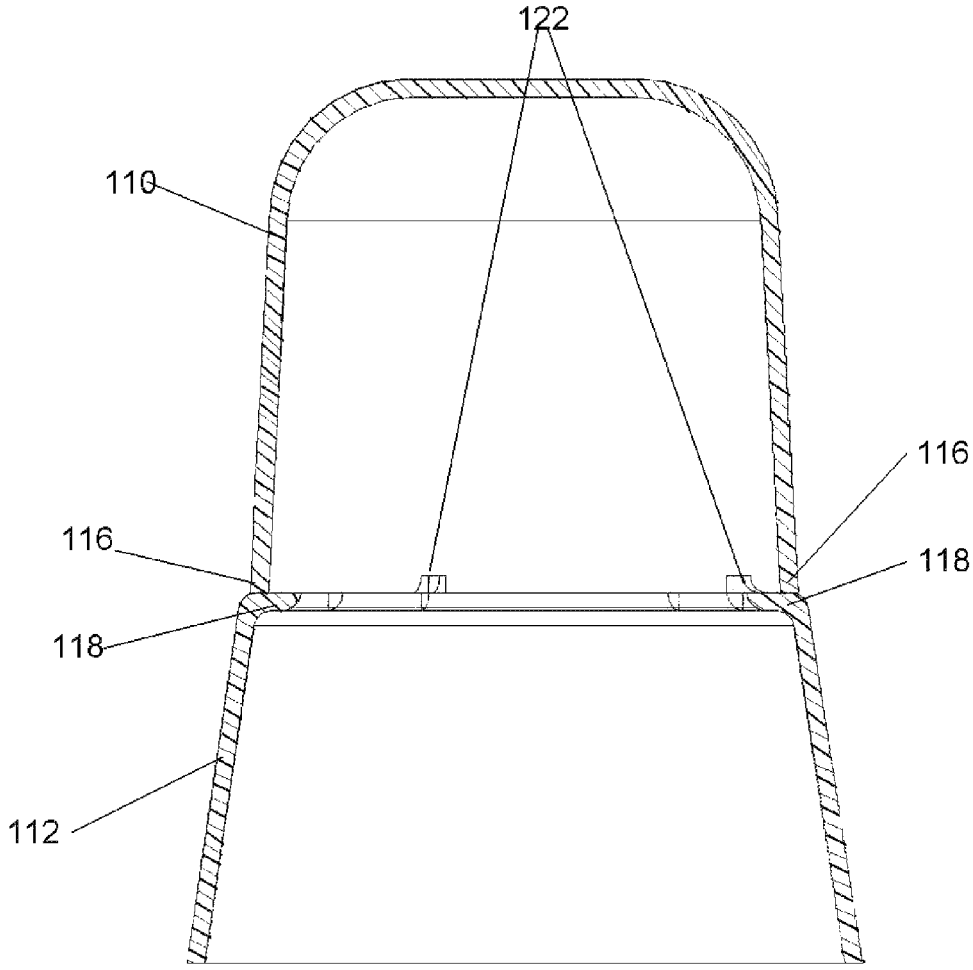
FIG. 7 is a cross sectional view of the combined upper and lower housings of the flashing light module of FIG. 1 along planes A-A and C-C.

As shown in FIGS. 5-6, lower housing 112 is shaped generally like a truncated cone, with a flange 118 extending radially inward at the upper truncation surface. Flange 118 includes notches 120, upwardly extending stops 122, and tongue portions 124 for mating with corresponding features on battery container 114 in a tongue and groove relationship. Referring to FIG. 7, upper housing 110 and lower housing 112 are joined with the lower edge 116 of upper housing 110 attached to the outer portion of flange 118, such as by gluing or bonding. Alternatively, housing 104 may be formed integrally as a single piece.

Figure 8:
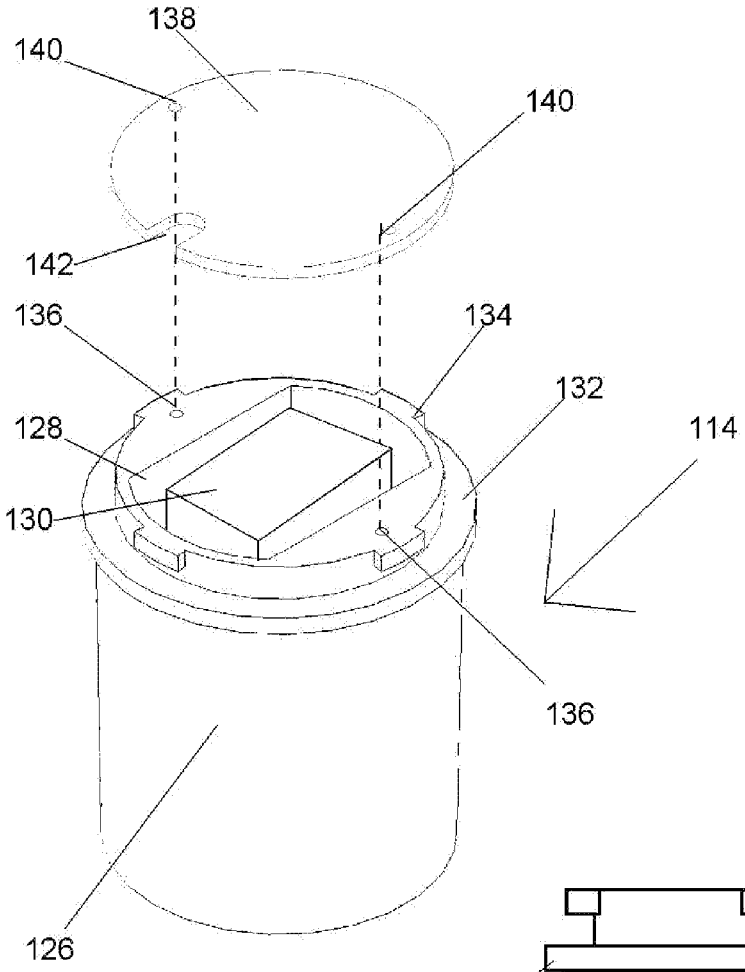
FIG. 8 is an exploded perspective view of a battery container and lid for the flashing light module of FIG. 1.
Figure 9:
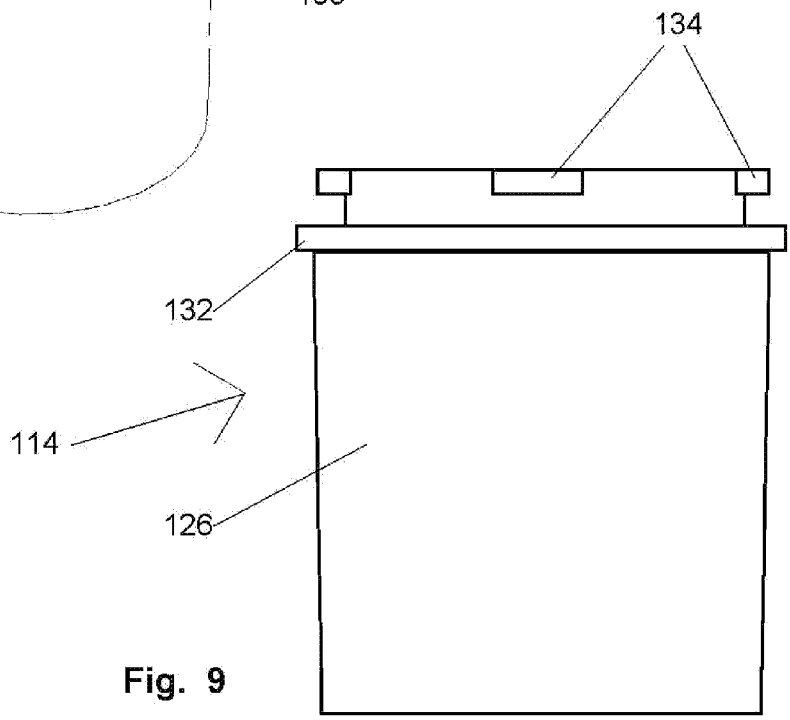
FIG. 9 is a side view of the battery container of FIG. 8.

As shown in FIGS. 8-9, battery container 114 has a substantially cylindrical outer surface 126 with an interior well 128 shaped and sized to contain a battery 130. Flange 132 extends radially outward from the upper portion of outer surface 126 and functions to support the light unit on a truncated traffic cone, with most of the battery container 126 inside the cone. The top of battery container 114 has a plurality of tabs 134 extending radially outward and spaced apart from flange 132. Tabs 134 are alignable with notches 120 of lower housing 112, and relative rotation of the housing 104 positions tongue portions 124 of lower housing 112 between tabs 134 and flange 132 to secure the lower housing 112 onto the battery container 114 via a tongue and groove relationship. The upper surface of battery container 114 includes openings 136 sized to accommodate screws, pins or other fasteners. Battery container lid 138 is sized to cover the well 128 in battery container 114. Openings 140 in lid 138 are alignable with openings 136 in battery container 114 to accommodate suitable fasteners (not shown) that join the lid 138 to the container 114. Slot 142 provides space for wires or electrical cables passing between a battery inside container 114 and the light assembly positioned above battery container lid, as discussed below. It should be noted that well 128 is shown with straight sides and rounded ends, but it could have any shape that accommodates the desired type of battery or other power source.

Figure 12:
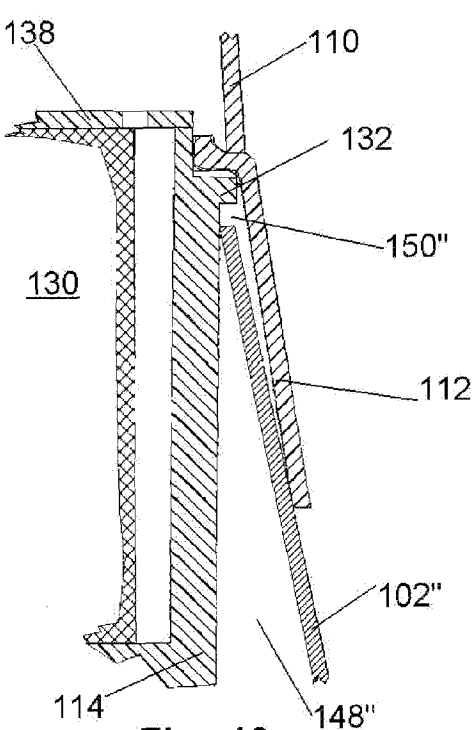
FIG. 12 is a partial cross section detail of still another cone and flashing light module of FIG. 1.
Figure 11:
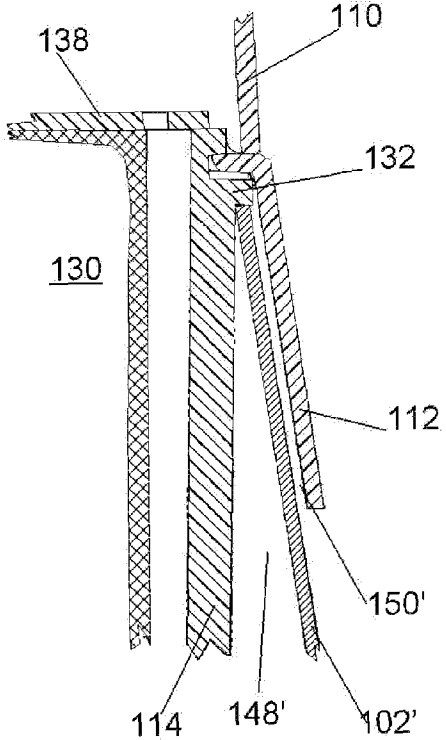
FIG. 11 is a partial cross section detail of another cone and the flashing light module of FIG. 1.
Figure 10:
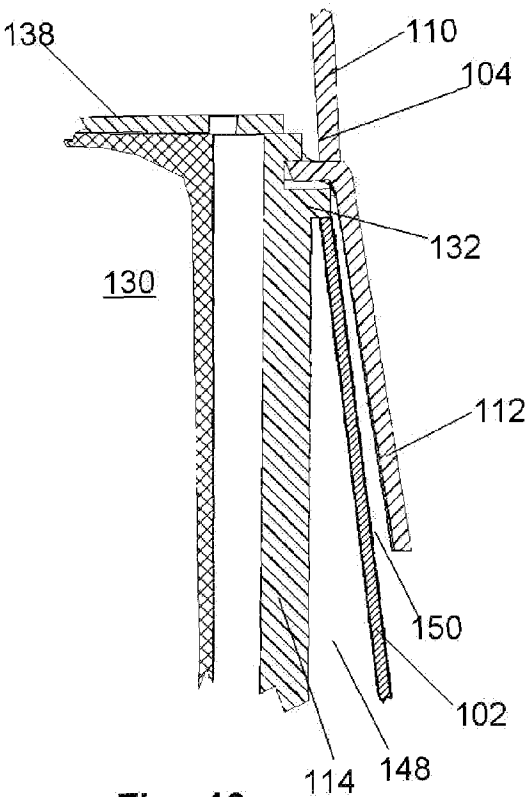
FIG. 10 is a partial cross section detail of the cone and the flashing light module of FIG. 1.

Referring to FIGS. 10-12, battery container 114, container lid 138, and housing 104 can be assembled and placed into the opening formed in a top-truncated traffic safety cone. Battery container flange 132 rests on the truncated surface 144, 144', or 144" of cone 102, 102', or 102", respectively, with gasket or O-ring 146 providing a water-tight seal between the lower housing 112 and the battery container 114. Depending on the angle at which the wall of the cone 102, 102', or 102" slopes, a space 148, 148', or 148" separates the inner surface of cone 102 and battery container 114, and a space 150, 150', or 150" separates the outer surface of the cone and the inner surface of lower housing 112. As can be seen in FIG. 12, if the slope of the cone wall is relatively shallow, the lower portion of lower housing 112 may rest upon the outer surface of cone 102", with battery container flange 132 positioned slightly above the top of cone 102".

It is contemplated that any suitable type of battery known in the art may be placed inside battery container 114. Preferably, the battery 130 is rechargeable without needing to be removed from the container 114. One suitable battery is a rechargeable 12-volt battery. Optionally, a solar cell (not shown) may be positioned on top of the housing or in any other location where it receives adequate sunlight to function. The solar cell can be used to charge the battery.

Figure 14:
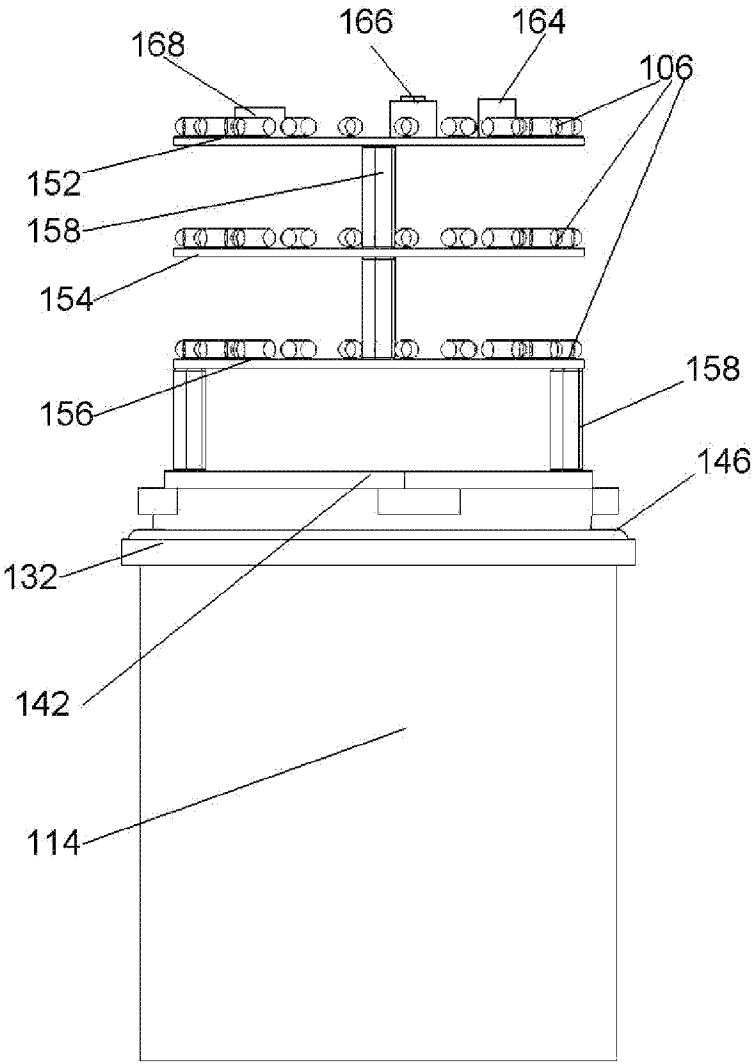
FIG. 14 is a side view of the battery container and three stacked LED boards of the embodiment of FIG. 1, with the upper and lower housing removed.
Figure 13:
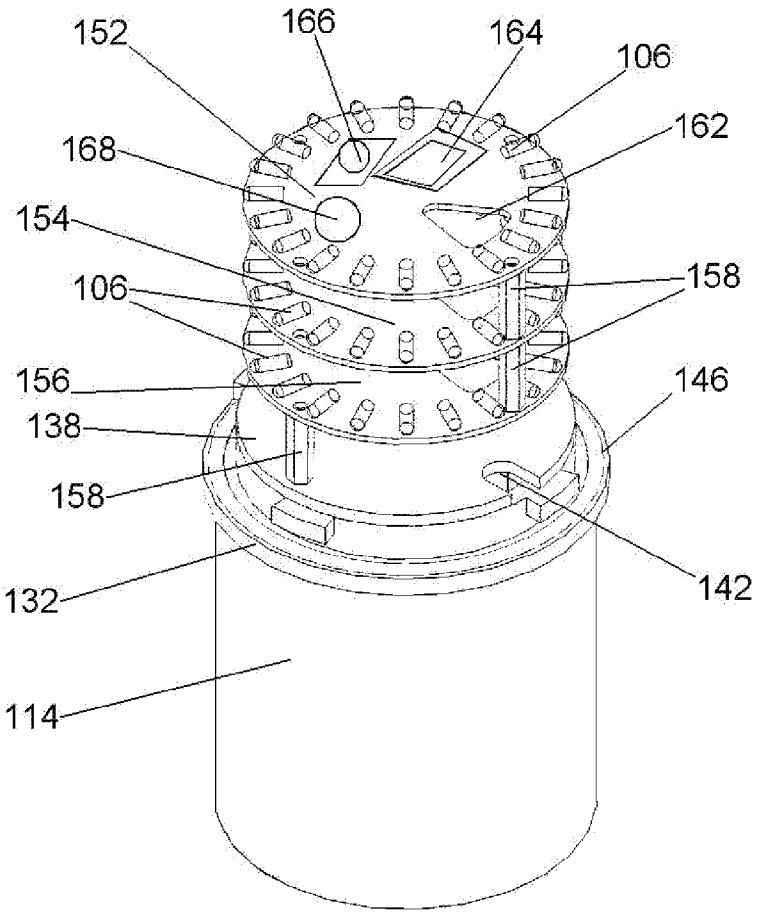
FIG. 13 is a perspective view of the battery container and three stacked LED boards of the embodiment of FIG. 1, with the upper and lower housing removed.
Figure 15:
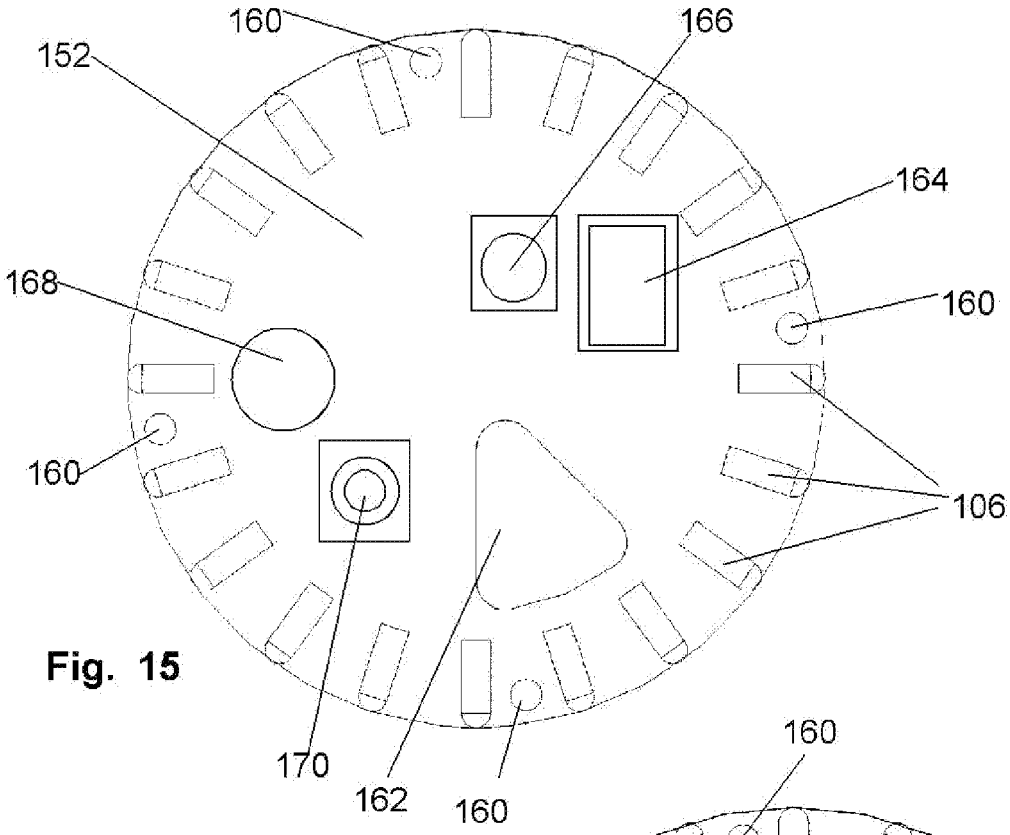
FIG. 15 is a top view of the top LED board of the embodiment of FIG. 1.
Figure 16:
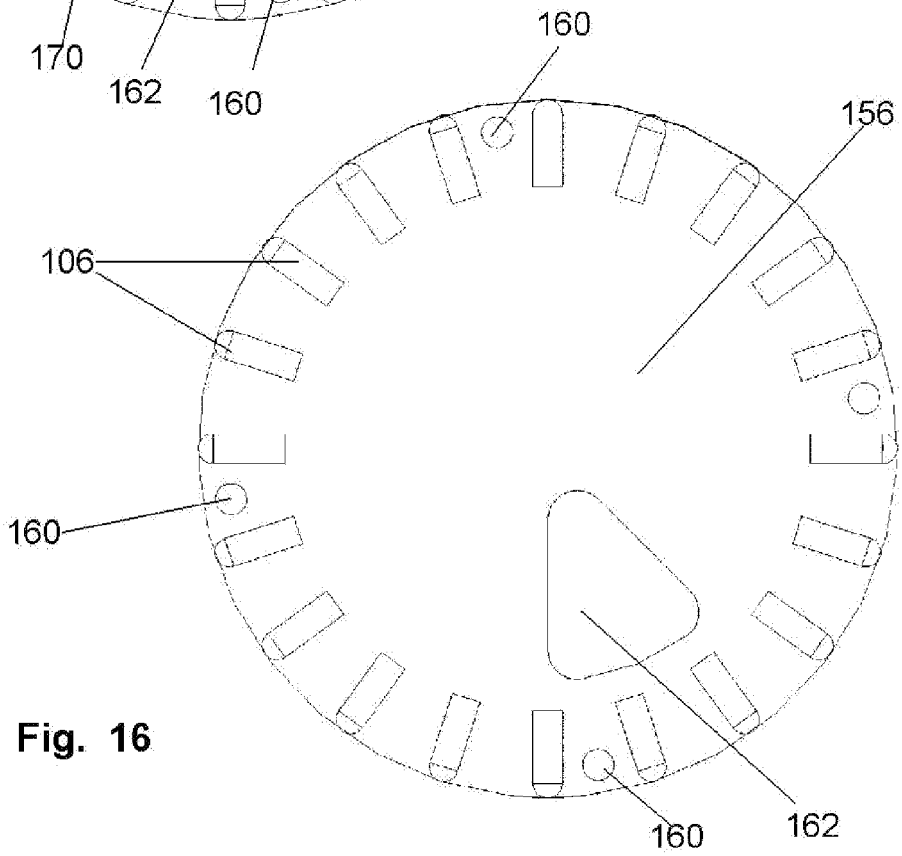
FIG. 16 is a top view of one of the lower LED boards of the embodiment of FIG. 1.

As shown in FIGS. 13-14, three boards 152, 154, and 156, each with a circular array of LED lights 106 mounted thereon, are supported on posts 158 above the battery container lid 138. The LED lights 106 provide 360-degree visibility around the cone onto which the light unit is mounted. As shown in FIGS. 13, 15, and 16, each board 152, 154, and 156 includes through holes 160 through which screws or other fasteners (not shown) pass to secure the board onto the underlying support posts 158. An additional through hole 162 allows wires to pass between the light arrays and a battery in the battery container 114. Preferably, boards 152, 154, and 156 are printed circuit boards, with appropriate switches, control devices, connectors, and other electronics incorporated into the circuits or mounted onto the boards. Wires and connectors, not shown, interconnect the boards and the battery or other power source. It should be noted that LED lights 106 are preferred because they provide bright light with low power usage, but other types of lights could be used.

As shown in FIGS. 13 and 15, a manually operable on/off switch 164 and a manually operated flash rate controller switch 166 are mounted onto the top board 152, where they are easily accessible when the housing 104 is removed. Alternatively, remotely operated switches could be used, eliminating the need to place the switches on the top board. Flash rate controller switch 166 allows the rate at which the LED lights 106 flash to be varied, for example, between a steady "ON" state and any desired flash duration, with any desired interval between flashes. Optionally, the electrical circuitry can allow for coordinated flashing of the lights in a group of cones. For example, it may be desirable to have lights on adjacent cones flash simultaneously, or it may be desirable to have them flash in sequence. An optional light sensor 168 senses ambient light and, via control circuitry, adjusts the LED light intensity in accordance with ambient light, including adjusting the light intensity between varying states of daylight as well as for night-time use. Use of the light sensor 168 may eliminate the need for the manually operable on/off switch 164. One or more of the boards 152, 154, and 156 or the battery container 114 or the container lid 138 may include a connector 170, shown in FIG. 15, for attaching an external battery charger, for example, an automobile cigarette lighter. Preferably, the battery connector is accessible by removing no more than the housing from the flashing light unit, without having to disassemble the stack of boards and light arrays to access the battery inside the battery 130 inside battery container 114. More preferably, the battery connector is located on the topmost board, as shown in FIG. 15, to provide easy access.

Figure 17A:
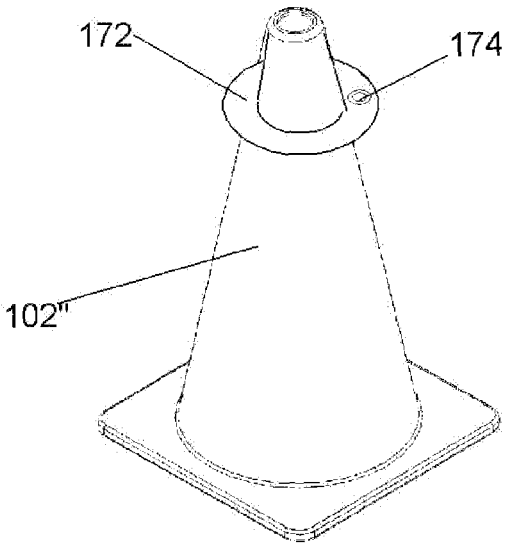
FIG. 17*a* is a side view of the cone of FIG. 10 with a template for marking the cone for truncation.
Figure 17B:
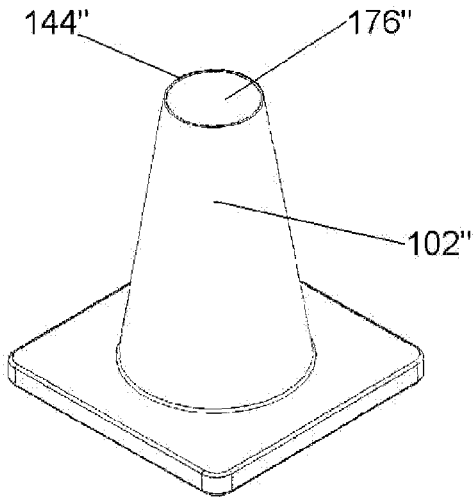
FIG. 17*b* is a side view of the truncated cone of FIG. 17*a;*
Figure 18A:
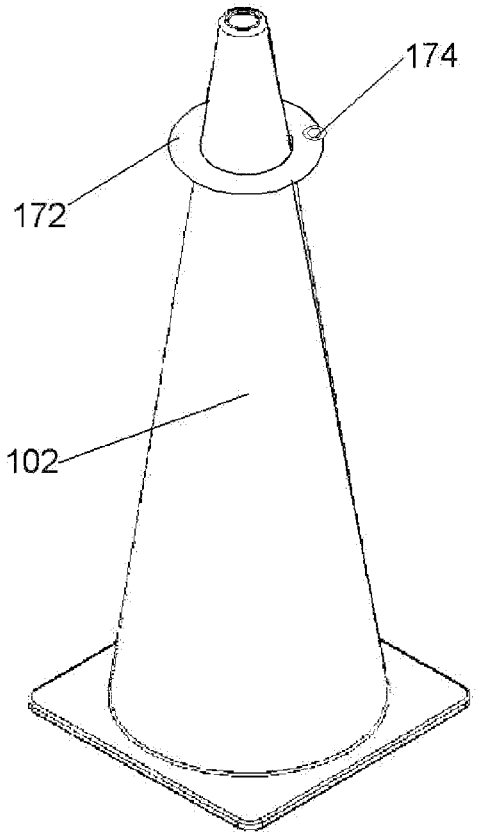
FIG. 18*a* is a side view of the cone of FIG. 12 with a template for marking the cone for truncation.
Figure 18B:
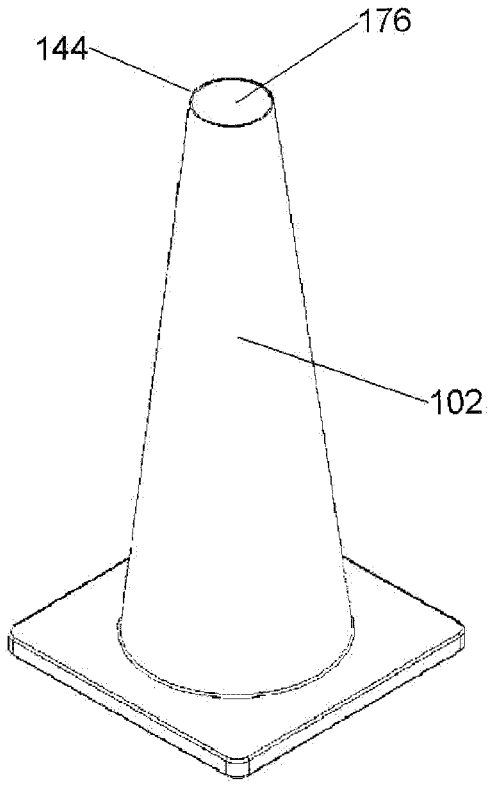
FIG. 18*b* is a side view of the truncated cone of FIG. 17*a*.

Preferably, a single size light unit 108 can be used with a variety of sizes and shapes of traffic cones, with battery container 114 recessed into the cone. As shown in the drawings, battery container 114 is substantially cylindrical, with a diameter somewhat larger than the openings found at the tops of most commercially available traffic cones. Thus, the top portion of the cone must be removed, such as by cutting, to provide an opening large enough to accommodate the battery container. It is desirable to use a template for cutting the tops off of the cones, avoiding the need to take any measurements. As shown in FIGS. 17-18, a template may formed from a sheet or ring of a substantially rigid material with a central through hole sized to match the diameter of the battery container 114. As shown in FIGS. 17*a* and 18*a*, one can simply slide the template 172 over the top of a cone 102 or 102", making sure the template 172 is horizontal (or perpendicular to the central axis of the cone if the cone is tilted), and mark the position where the cone is to be cut. The template is then removed, and the cone is cut, such as with a utility knife or shears. It may be desirable to include a bubble-type level indicator 174 on the template. The opening 176 in the truncated cone must be small enough that the battery container flange 132 can rest on the upper edge 144 or 144" of the truncated cone and support the light array boards 152, 154, and 156 and the housing 104, as shown in FIGS. 10-12, without falling through the opening 176 or 176" at the top of the cone. Recessing the battery container into the cone lowers the center of gravity of the cone and the light unit and provides more stability than if the entire unit is placed around the top of a traffic cone or above a traffic cone.

The housing 104, battery container 114, and resilient gasket or O-ring 146 provide a water-tight seal, substantially eliminating the possibility that water, snow, ice, etc. can penetrate into the interior of the upper housing 110 or battery container 114. The skirt formed by lower housing 112 provides additional protection. Possible sources of moisture include dew, fog, falling rain, falling snow, ice, accumulated water due to flooding, accumulated snow due to a heavy snowfall or plowing, and water splashed from the ground by a passing vehicle or sprayed during road construction.

The various components of the light unit can be manufactured and assembled by methods known in the art. The housing is preferably a transparent or translucent material, such as acrylic, and it may be colored to impart any desired externally viewed light color. The battery container and lid are preferably formed from a non-conducting material, such as polypropylene. The LED boards may be conventionally manufactured circuit boards, with commercially available switches and connectors attached.

In use, the housing is removed from a light unit to manually turn the unit on and set the flash rate. The housing is then replaced onto the battery container, and the unit is placed onto a truncated traffic cone. The housing is removable and replaceable to turn the unit off, change the flashing rate, or charge the battery within the battery container. Alternatively, a remote control could be used to operate the switches.

The traffic safety cone and light module of the present invention can be used in any setting in which it is desirable to use visual traffic alert devices. For example, one or more cones and light modules could be carried in vehicles used for purposes that include frequent occasions for notifying passing traffic of an obstacle. Examples of such vehicles include law enforcement vehicles; fire engines; vehicles used for servicing utilities along roadways, such as for servicing power lines, telephone cables, television cables, sanitary sewer lines, water and gas lines, etc.; and tow vehicles. The cones and light modules can be used at road construction and repair sites. It may be desirable to carry two or more cones and light modules in vehicles, so the cones and light modules can be placed in front of and behind the vehicle to warn oncoming traffic when the vehicle is stopped along a roadway, stalled, or otherwise disabled. The cones and light modules can be used at public gatherings, such as to mark entrances, exits, or pathways to be followed. They can also be used to mark school crossings. Another use is on boats, such as when anchored or moored at sites where they could present obstacles to other marine traffic.

Figure 19:
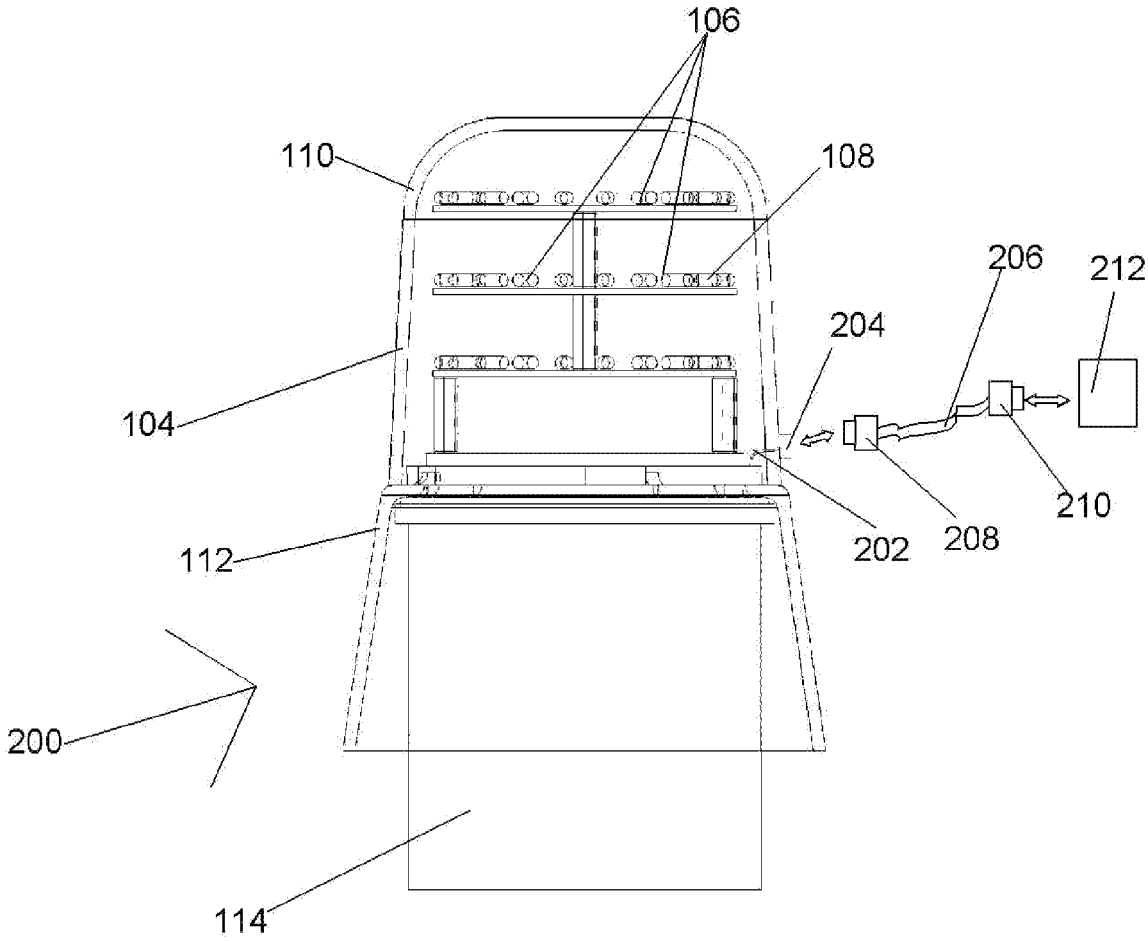
FIG. 19 is a front view another embodiment of a flashing light module in accordance with the present invention.

It may be desirable to operate the flashing light module directly from an external power source. For example, as shown in FIG. 19, flashing light module 200 includes the same components as light module 100, along with suitable electrical wire 202 connected to a connector 204 that is accessible from the exterior of housing 104. External cable 206 has a connector 208 that interfaces with connector 204 and a second connector 210 that interfaces with external battery or power source 212. Base 214 fits into the opening at the top of a truncated traffic safety cone and supports the module on the cone. Module 200 can be operated by connecting cable 206 between connectors 208 and 210. The power source could be a 12-volt vehicle battery, such as by connecting the cable to the cigarette lighter in the vehicle. Alternatively, other external batteries or power sources could be used. Thus, a cone and light module could be carried in a vehicle or stored for extended periods of time, yet available for emergency use without the need to recharge or replace an internal battery that has lost its charge during extended storage. The internal battery may be eliminated, or the unit may be operable either using the internal battery or using external power.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. A light module for a traffic safety cone, said module comprising:

a base having a radially outward-extending flange, said flange sized to support said module on a traffic safety cone with said base substantially within the cone;

a light-transmissive housing;

means for removably joining said housing and said base with a substantially water-tight seal between said housing and said base;

a plurality of electrically-interconnected circular printed circuit boards located within said housing, each printed circuit board having a radial array of outwardly-facing, light-emitting diodes mounted on a periphery thereof, said light-emitting diodes operative so as to provide light visible in a 360-degree arc around said light module, said plurality of circular printed circuit boards arranged in a spaced-apart, coaxially-stacked configuration, in which a lowermost printed circuit board is mounted to said base and elevated therefrom with posts, and an uppermost printed circuit board is equipped with all other circuitry components required for operating and controlling said light-emitting diodes.

2. The light module of claim 1, wherein said base comprises:

an electrically insulating battery container having a space therein sized to accommodate a battery;

a container lid covering the space in said battery container, said lid having an opening therethrough sized to accommodate electrical wires; and a battery within said space in said battery container, said battery in electrical communication with said electrical circuitry.

3. The light module of claim 2, wherein:

said battery is rechargeable; and said light module includes a connector for recharging said battery from an external power source.

4. The light module of claim 1, wherein said means for removably joining said housing and said base comprises a tongue-and-groove mating system and a resilient seal.

5. The light module of claim 1, wherein before light-emitting diodes and any other electrical components are mounted on the printed circuit boards, the printed circuit boards are substantially identical.

6. The light module of claim 1, further comprising means for coordinating light flashes of said array of light sources with light flashes of arrays of light sources in nearby modules.

7. The module of claim 1, further comprising a connector for receiving power from an external power source.

8. The light module of claim 1, wherein said electrical circuitry is contained within the enclosed space formed between said battery container and said housing, said circuitry comprising at least one component selected from the group or on/off switches, light flash rate controllers, ambient light sensors, light intensity controllers, connectors for recharging said battery, solar cells for recharging said battery, and combinations thereof.

9. The traffic safety cone of claim 1, further comprising a connector for receiving power from an external power source.

10. A traffic safety cone with a light module, said module comprising:

a base having a radially outward-extending flange, said flange sized to support said module on a traffic safety cone with said base substantially within the cone;

a light-transmissive housing;

means for removably joining said housing and said base with a substantially water-tight seal between said housing and said base;

a plurality of electrically-interconnected circular printed circuit boards located within said housing, each printed circuit board having a radial array of outwardly-facing, light-emitting diodes mounted on a periphery thereof, said light-emitting diodes operative so as to provide light visible in a 360-degree arc around said light module, said plurality of circular printed circuit boards arranged in a spaced-apart, coaxially-stacked configuration, in which a lowermost printed circuit board is mounted to said base and elevated therefrom with posts, and an uppermost printed circuit board is equipped with all other circuitry components required for operating and controlling said light-emitting diodes wherein said cone has a truncated top portion providing an opening sized to receive said base and support said base via said flange.

11. The traffic safety cone of claim 10, wherein said electrical circuitry is contained within the enclosed space formed between said base and said housing, said circuitry comprising at least one component selected from the group or on/off switches, light flash rate controllers, ambient light sensors, light intensity controllers, connectors for recharging said battery, solar cells for recharging said battery, and combinations thereof.

12. The traffic safety cone of claim 10, wherein before light-emitting diodes and any other electrical components are mounted on the printed circuit boards, the printed circuit boards are substantially identical.

13. The traffic safety cone of claim 10, wherein said base comprises:

an electrically insulating battery container having a space therein sized to accommodate a battery;

a container lid covering the space in said battery container, said lid having an opening therethrough sized to accommodate electrical wires; and a battery within said space in said battery container, said battery in electrical communication with said electrical circuitry.

14. The traffic safety cone of claim 10, wherein said means for removably joining said housing and said base comprises a tongue-and-groove mating system and a resilient seal.

15. The traffic safety cone of claim 10, wherein:

said battery is rechargeable; and said light module includes a connector for recharging said battery from an external power source.

* * * * *